US007867013B2

(12) United States Patent
Cox et al.

(10) Patent No.: US 7,867,013 B2
(45) Date of Patent: Jan. 11, 2011

(54) IN-LINE SPLICE CONNECTOR

(75) Inventors: Larry Cox, Georgetown, TX (US); Sidney J. Berglund, Round Rock, TX (US); Jerome A. Pratt, Round Rock, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/501,873

(22) Filed: Jul. 13, 2009

(65) Prior Publication Data

US 2010/0029129 A1 Feb. 4, 2010

Related U.S. Application Data

(60) Provisional application No. 61/085,922, filed on Aug. 4, 2008.

(51) Int. Cl.
*H01R 4/24* (2006.01)

(52) U.S. Cl. ..... 439/404

(58) Field of Classification Search ..... 439/409, 439/410, 387, 402, 413
See application file for complete search history.

(56) References Cited

U.S. PATENT DOCUMENTS 4,379,605 A * 4/1983 Hoffman ..... 439/107
4,684,195 A * 8/1987 Anderson et al. ..... 439/404
5,338,220 A * 8/1994 Soes et al. ..... 439/403
5,504,654 A * 4/1996 Knox et al. ..... 361/119
6,152,760 A * 11/2000 Reeser ..... 439/409
6,769,931 B2 8/2004 Negishi et al.
7,234,961 B2 6/2007 Arlitt et al.

FOREIGN PATENT DOCUMENTS

| | | | |
|---|---|---|---|
| BR | 9902716 | A | 3/2006 |
| BR | 0601116 | A | 8/2006 |
| EP | 0 443 264 | B1 | 5/1994 |
| JP | 09-274944 | | 10/1997 |
| WO | WO 99/04455 | A | 1/1999 |
| WO | WO 02/13316 | A | 2/2002 |

OTHER PUBLICATIONS

Form PCT/ISA/210, dated Dec. 16, 2009, issued in PCT/US2009/052339.

* cited by examiner

*Primary Examiner*—Phuong K Dinh
(74) *Attorney, Agent, or Firm*—Gregg H. Rosenblatt

(57) ABSTRACT

An in-line splice connector comprises a connector body having a first end and a second end opposite the first end and having a generally elongated cavity region formed between the first and second ends to house at least a first insulation displacement connector (IDC) element. The in-line splice connector also includes a first cap and a second cap, each cap including a wire guide to receive and guide a wire to the IDC element. The first cap is pivotally mounted at the first end of the connector body to receive a first wire and the second cap is pivotally mounted at the second end of the connector body to receive a second wire. A closing of the first and second caps actuates a splice of the first and second wires.

14 Claims, 13 Drawing Sheets

IN-LINE SPLICE CONNECTOR

CROSS REFERENCE TO RELATED APPLICATION

This application claims the benefit of U.S. Provisional Patent Application No. 61/085,922, filed Aug. 4, 2008, the disclosure of which is incorporated by reference herein in its entirety.

BACKGROUND

1. Field

The present invention is directed to an in-line splice connector.

2. Related Art

An insulation displacement connector ("IDC" or "IDC element") can be used to make the electrical connection or splice between two wires or electrical conductors. The IDC element displaces the insulation from a portion of the electrical conductor when the electrical conductor is inserted into a slot within the IDC element such that the IDC element makes an electrical connection to the electrical conductor. Once the electrical conductor is inserted into the slot, and the wire insulation is displaced, electrical contact is made between the conductive surface of the IDC element and the conductive core of the electrical conductors that contact the IDC element.

In-line connectors for splicing insulated wires are known, such as is described in U.S. Pat. No. 4,684,195.

However, some conventional in-line splice connectors are not compatible with certain categories of electrical wire. Also, conventional in-line splice connectors do not firmly grip wires prior to full connector closure and do not meet minimum tensile pull-out requirements.

SUMMARY

According to a first aspect of the present invention, an in-line splice connector comprises a connector body having a first end and a second end opposite the first end and having a generally elongated cavity region formed between the first and second ends to house at least a first insulation displacement connector (IDC) element. The in-line splice connector also includes a first cap and a second cap, each cap including a wire guide to receive and guide a wire to the IDC element. The first cap is pivotally mounted at the first end of the connector body to receive a first wire and the second cap is pivotally mounted at the second end of the connector body to receive a second wire. Closing the first and second caps actuates a splice of the first and second wires.

According to another aspect of the present invention, an in-line splice connector comprises a connector body having a first end and a second end opposite the first end and having a generally elongated cavity region formed between the first and second ends to house at least a first insulation displacement connector (IDC) element. The in-line splice connector also includes a first cap and a second cap, each cap including a wire guide to receive and guide a wire to the IDC element. The IDC elements each comprise an elongated U-shape that includes a main base portion that connects first and second end portions, wherein each of the first and second end portions include a V-shaped and coined entrance slot to receive a wire, the V-shaped and coined entrance slot being configured to urge the wire towards the main base portion upon an axial pull of the wire away from the in-line splice connector.

According to another aspect of the present invention, an in-line splice connector comprises a connector body that includes a first end and a second end opposite the first end and a generally elongated cavity region formed between the first and second ends to house at least a first insulation displacement connector (IDC) element. The in-line splice connector also includes a first cap and a second cap, each cap including a wire guide to receive and guide a wire to the IDC element, where the IDC element comprises an elongated U-shape that includes a main base portion that connects first and second end portions. The first cap is pivotally mounted to the connector body at a position between the first end of the connector body and the first end portion of the IDC element.

The above summary of the present invention is not intended to describe each illustrated embodiment or every implementation of the present invention. The figures and the detailed description that follows more particularly exemplify these embodiments.

BRIEF DESCRIPTION OF THE DRAWINGS

The present invention will be further described with reference to the accompanying drawings, wherein.

Figure 1:
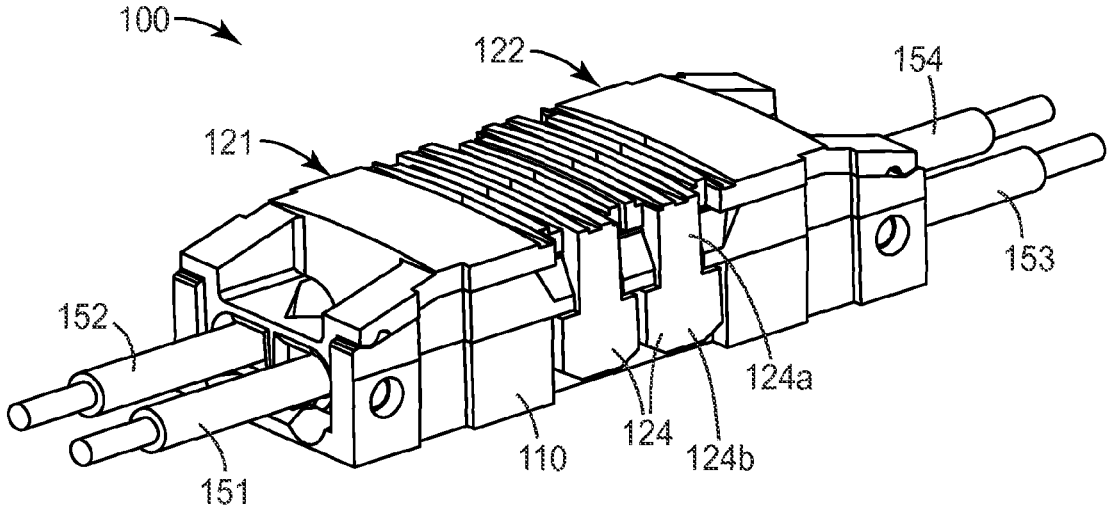
FIG. 1 is an isometric view of an in-line splice connector according to an aspect of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the invention as defined by the appended claims.

DETAILED DESCRIPTION OF THE EMBODIMENTS

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "forward," "trailing," etc., may be used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention.

The present invention is directed to an in-line splice connector for creating a splice of one or more wires of varying sizes. The in-line splice connector includes a structure and retention feature that anchors wires to be spliced to an IDC element in the splice connector prior to full actuation. This structure and retention feature reduces the risk of wire disengagement during the splicing sequence, which can occur when wires under tension are spliced. An audible click-type sound indicates full actuation of the in-line splice connector.

FIG. 1 shows an isometric view of an exemplary in-line splice connector 100 according to a first aspect of the present invention. In-line splice connector 100 includes a connector body 110 that houses one or more insulation displacement connector elements (IDC elements 131, 132, see FIG. 2). First and second caps 121, 122 actuate the splicing of one or more wires 151, 152, 153, and 154 in an in-line manner. As shown in FIG. 1, in-line splice connector 100 splices wire 151 to wire 153 and it splices wire 152 to wire 154. In particular, the in-line splice connector 100 structure includes two pivoting caps 121, 122 that each pivot from a position at an end portion of the connector body 110, as opposed to a center pivot structure that is used in conventional in-line splice connectors. For purposes of this description, a position "at an end portion" also includes a position near the end of the connector body.

Figure 2:
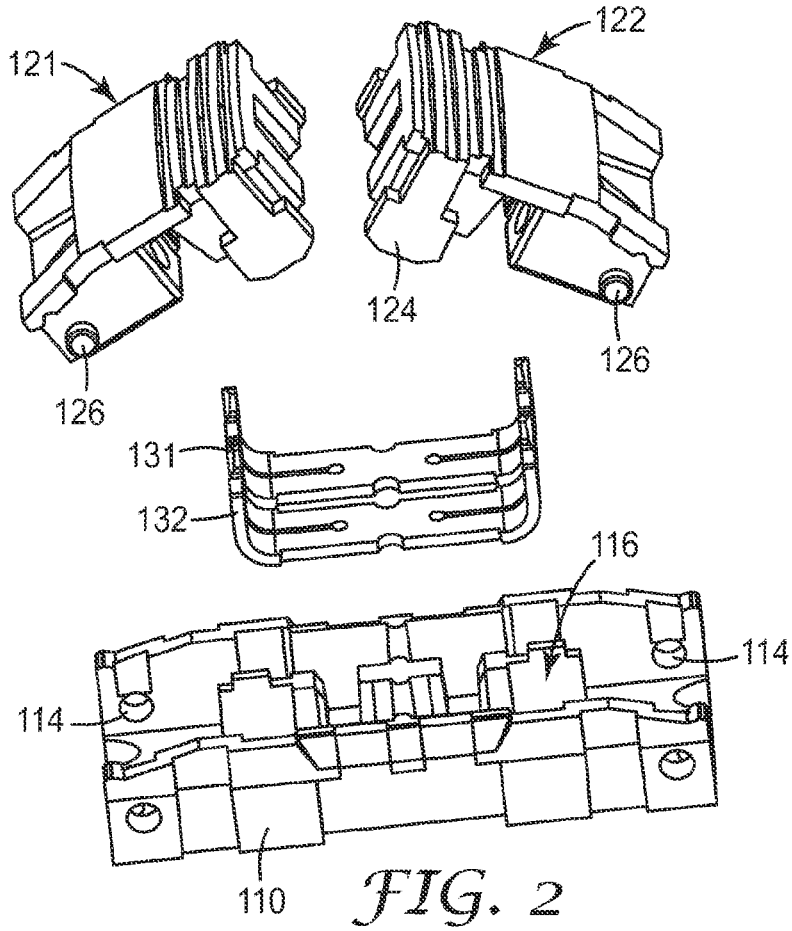
FIG. 2 is an exploded view of an in-line splice connector according to an aspect of the invention.

FIG. 2 shows an exploded view of in-line splice connector 100. The connector body 110 includes a generally elongated cavity region 116 formed in the central part of the body. IDC elements 131 and 132 are securely housed in the cavity region 116. In addition, the connector body 110 also includes receptacles 114 at (or near) each end and on opposite inside facing walls of the connector body. These receptacles 114 are configured to receive protrusions or trunnions 126 formed on caps 121, 122. In one exemplary aspect, the receptacles 114 are formed as through-holes.

The trunnion/receptacles interact to provide a pivot axis for each cap to move from an open position (where wires are inserted into the connector) to a closed position (where the wires are spliced). In this configuration, the caps pivot at (or near) the ends of the connector body so that each of the caps closes towards the center of the connector, thereby pushing the wires downward into the IDC elements during the actuation process. In a preferred aspect, the receptacles are located on the connector body at a position between the first end of the connector body and the first end portion of the IDC element. In this manner, the pivot point of the cap will be located between the first end of the connector body and the first end portion of the IDC element. As such, the interaction of the wires and the V-shaped and coined reception slots of the IDC elements can reduce or eliminate the risk of disengagement during the actuation process. Moreover, with the caps pivoted at (or near) each end of the connector, the inadvertent upward pulling of a spliced wire will not result in wire/cap disengagement. An exemplary splicing sequence is described below with respect to FIGS. 9A-9E.

According to an exemplary embodiment of the present invention, connector body 110 and caps 121 and 122 are formed or molded from a polymer material. In one exemplary aspect, connector body 110 and caps 121 and 122 are formed from a polycarbonate material. The caps and/or the connector body can also be formed from a transparent material, which provides for visual inspection of the wires prior to and after splicing.

Wires 151-154 can be standard size electrical conductors, such as copper or steel wires, having a diameter of from about 0.4 mm (26 gauge) to about 0.8 mm (20 gauge). Each wire has a jacket formed of an insulation material, such as polyvinylchloride (PVC). Also, wires 151-154 are not required to each be of the same size. For example, wire 151 can comprise a 24 gauge wire and wire 153 can comprise a 26 gauge wire, or vice versa. In one exemplary aspect, wires 151 and 152 are a conventional twisted wire pair for telecommunications applications, and can have either a solid or a stranded core. In an alternative aspect, as would be apparent to one of ordinary skill in the art given the present description, the in-line splice connector can be scaled in size to accommodate larger diameter wire.

Figure 3A:
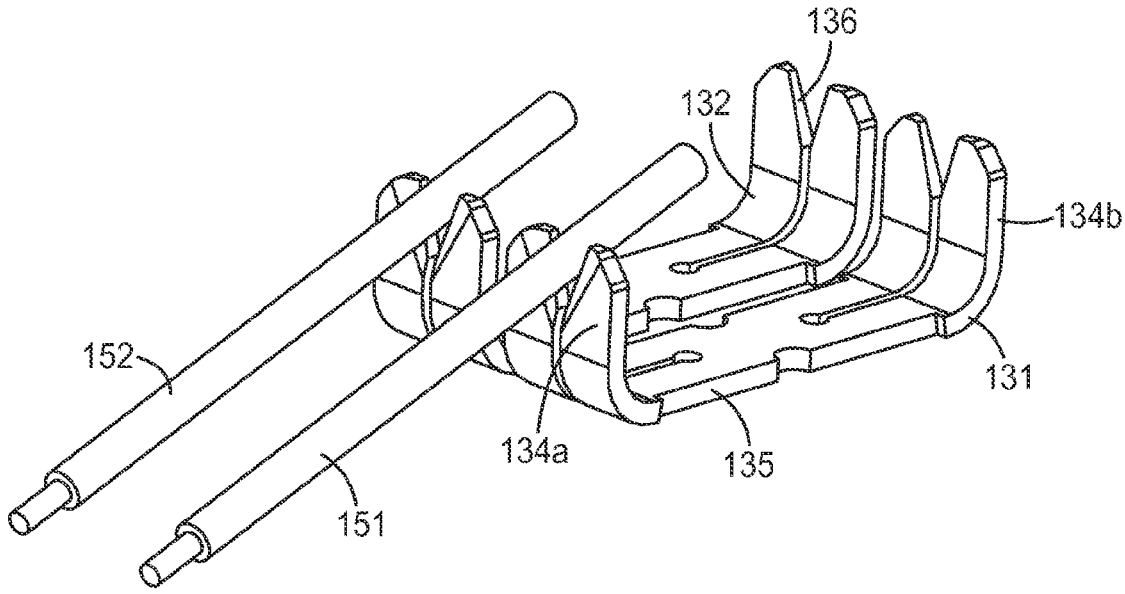
FIG. 3A is an isometric view of an IDC element of an in-line splice connector according to an aspect of the invention.

In more detail, FIG. 3A shows a close-up view of exemplary IDC elements 131, 132 receiving wires 151, 152 (with the remaining connector structure omitted for simplicity). Each IDC element 131, 132 has an elongated U-shape that includes a main base portion 135 that connects first and second end portions 134*a* and 134*b*. First end 134*a* and second end 134*b* each have a funnel or V-shaped slot wire reception 136 formed therein that are configured to engage the wires to be spliced. The V-shaped wire reception slots 136 have a structure that can displace the insulation layers of the wires inserted in them to allow contact with the conductor(s) in the wires.

Figure 3B:
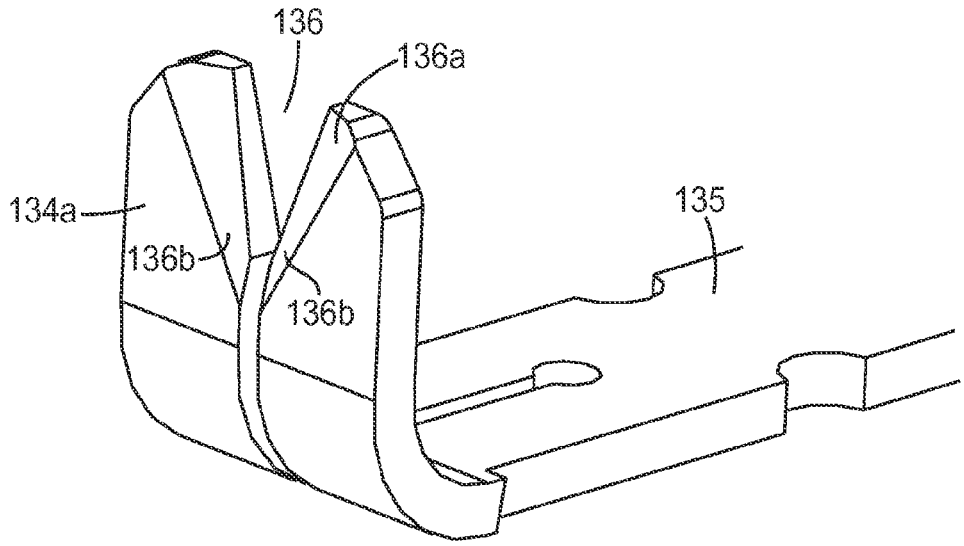
FIGS. 3B and 3C are close up views of a coined wire reception slot of an exemplary IDC element.
Figure 3C:
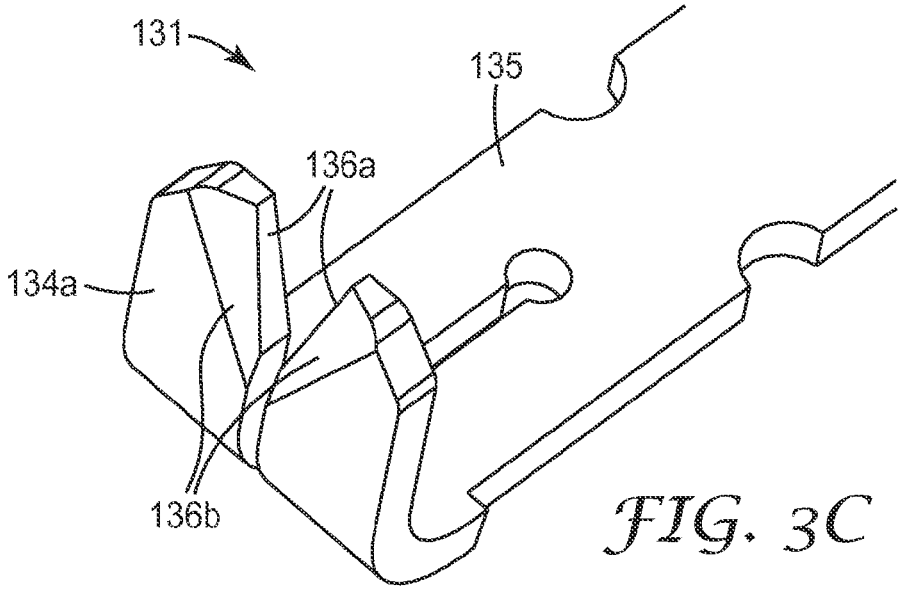

In an exemplary aspect, the upper or open ends of wire reception slots 136 are coined. This coining provides a sharper edge for the inner displacement channel and allows the wire insulation to be cut and engaged by the element with less downward force applied to the wire. Close-up views of a coined wire reception slot are shown in FIGS. 3B and 3C. In this example, wire reception slots 136 include a thinned upper coined region 136*a* that tapers to a lower coined region 136*b*. In this example, the thickness of the metal at lower coined region 136*b* matches the thickness of the remainder of the IDC element (except for the coined portion at the opposite end).

The IDC elements 131, 132 can both comprise a conductive metal material. In one exemplary embodiment, the IDC elements 131, 132 may be constructed of phosphor bronze alloy C521000 per ASTM B103/103M-98e2 with reflowed matte tin plating of 0.000150-0.000300 inches thick, per ASTM B545-97(2004)e2 and electrodeposited nickel underplating, 0.000050 inches thick minimum, per SAE-AMS-QQ-N-290 (July 2000).

Figure 4:
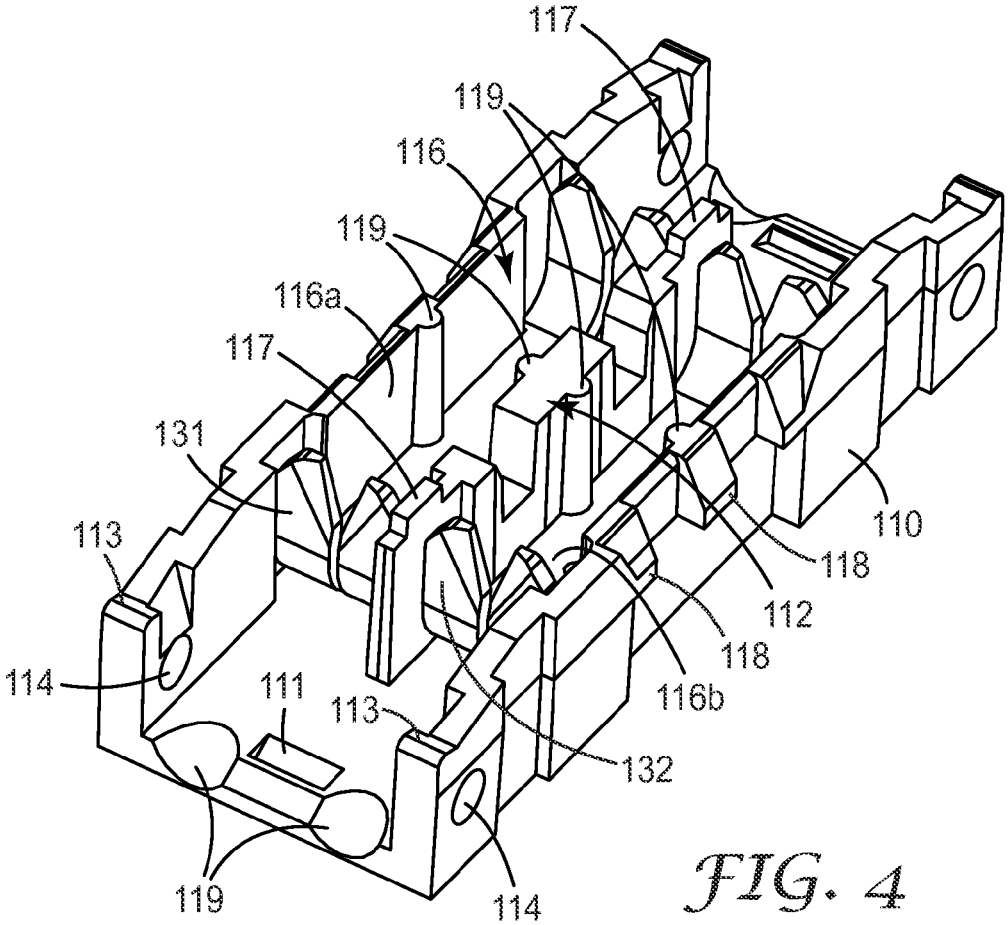
FIG. 4 is an isometric view of the connector body portion of an in-line splice connector according to an aspect of the invention.

FIG. 4 shows the elements 131 and 132 secured in the cavity region 116 of the connector body 110. In this exemplary aspect, connector body 110 includes a first cavity portion 116*a* and a second cavity portion 116*b* separated by a central wall 112. The central wall 112 and the inner surface of the connector body walls can include conforming guiding structures to help secure the IDC elements 131, 132 in place within the cavity region. For example, alignment guides 119 can be provided within cavities 116*a* and 116*b* to guide the IDC elements into the cavities at their proper location. In this exemplary aspect, IDC elements 131 and 132 can include interference tabs (not shown) so that the elements can be secured in cavity portions 116*a* and 116*b* using an interference fit, such that the IDC elements are held and will not shake, rotate, or be axially displaced in the connector body. The central wall can further include one or more rib structures 117 that are disposed thereon near the first and second ends of the IDC elements 131 and 132. These ribs 117 create a longer electrical arc path length between the ends of adjacent IDC elements to reduce potential electrical short problems.

Connector body 110 further includes protrusions or catches 118 formed on outer surfaces of connector body 110 that are configured to engage latches 124 that extend downward from the top portion of caps 121, 122. Preferably, each of the catches 118 has a tapered or outwardly slanting shape to force an outward bending of the latch upon engagement. As shown in FIG. 1, each latch 124 has a cantilevered arm 124*a* that is relatively short, and a retention piece 124*b*, each with sufficient stiffness to close onto the connector body with sufficient force. Thus, upon full actuation, the restorative force of the arm causes the latch 124 to make an audible "snap" or "click" sound when engaged with catches 118. In a preferred aspect, two latches 124 (one on each side) are included on each cap 121, 122. In this aspect, latches 124 each have a short arm 124*a* coupled to a wider retention piece 124*b*. This structure provides for more resistance during the latching process, strong retention once the cap is fully closed, and an audible snap or click sound upon closing.

Figure 7A:
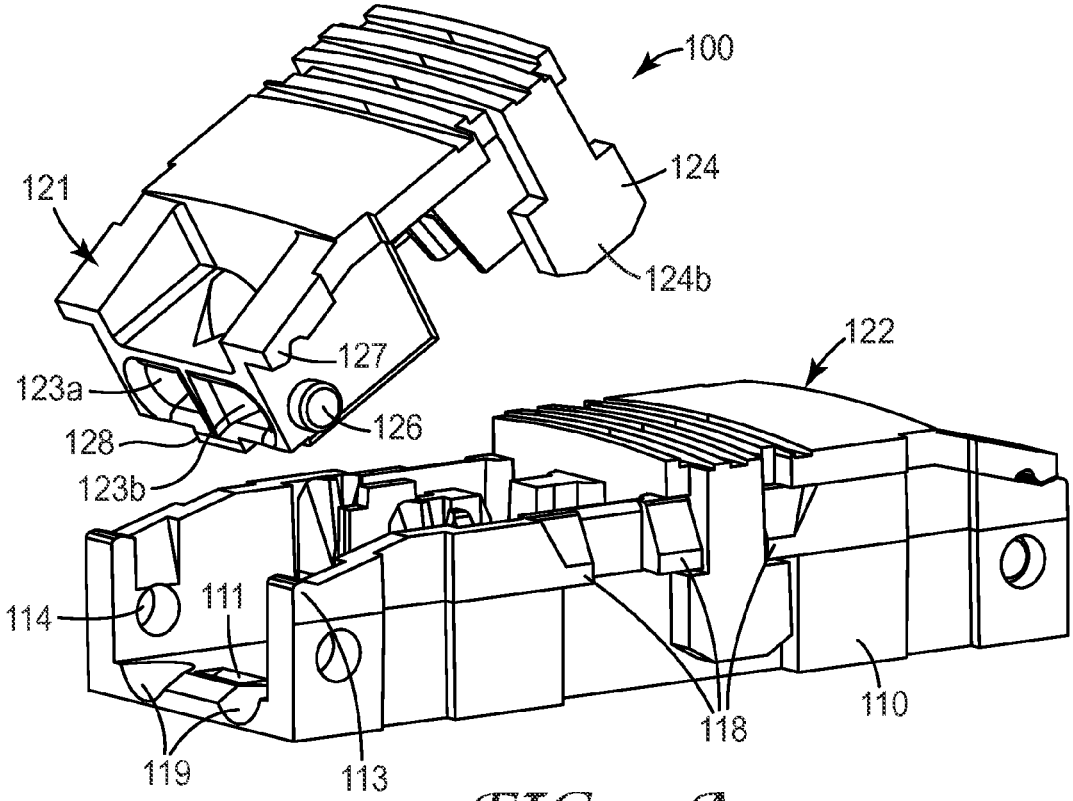
FIG. 7A is an isometric view of an in-line splice connector with a cap detached according to an aspect of the invention.
Figure 7B:
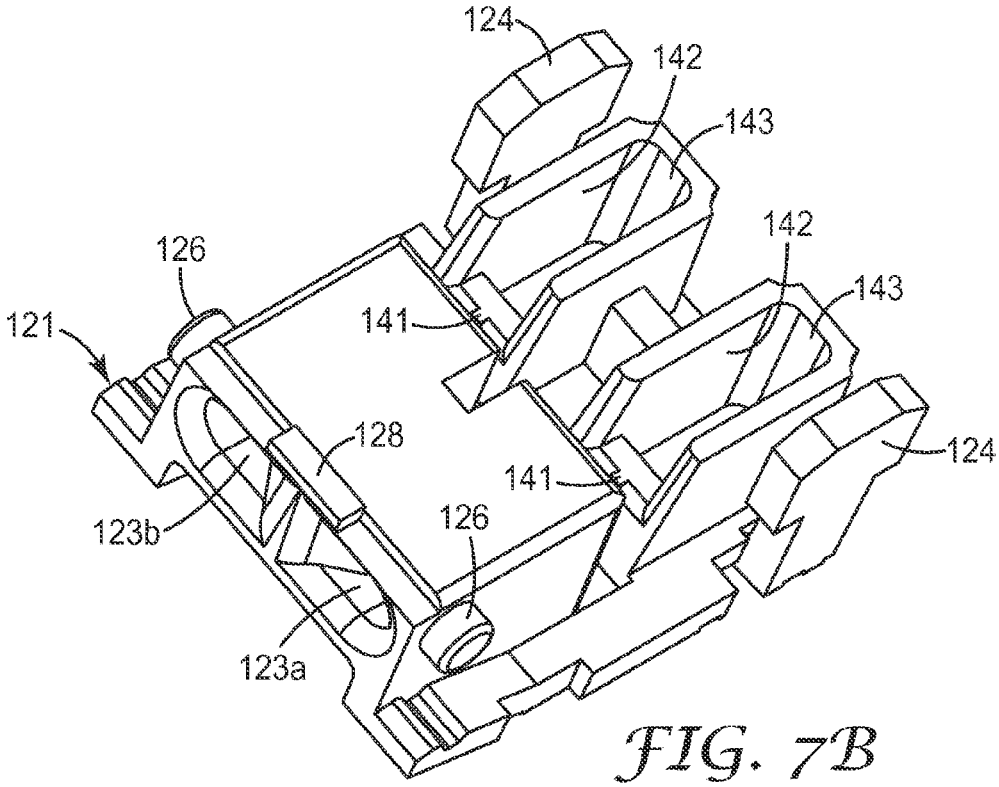
FIG. 7B is an isometric view of the underside of an exemplary cap of the in-line splice connector according to an aspect of the invention.
Figure 7C:
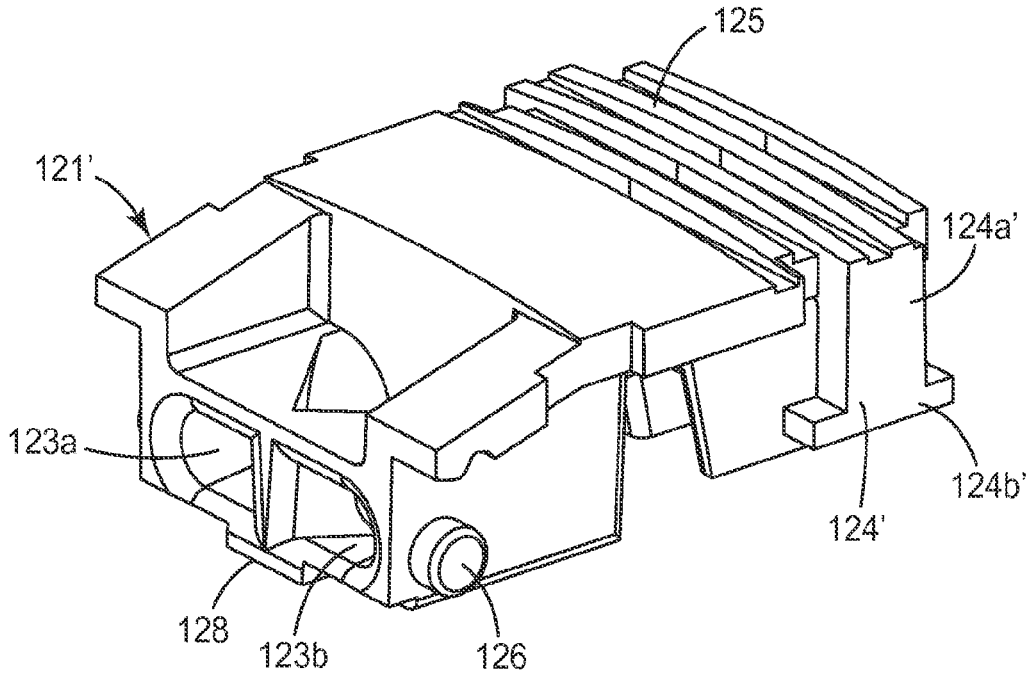
FIG. 7C is an isometric view of an exemplary cap of the in-line splice connector according to an alternative aspect of the invention.

An alternative cap 121' having an alternative latch 124' with a "T-shape" (with a longer post 124*a*' coupled to a narrower retention piece 124*b*') is shown in FIG. 7C.

The cavity regions 116*a*, 116*b* of the connector body can be filled with a sealant (not shown), such as a conventional gel, to help prevent moisture from entering the terminal compartment and corroding the terminal. Sealant materials useful in the exemplary embodiments include greases and gels, such as, but not limited to, RTV® 6186 mixed in an A to B ratio of 1.00 to 0.95, available from GE Silicones of Waterford, N.Y.

Gels, which are useful herein, may include formulations which contain one or more of the following: (1) plasticized thermoplastic elastomers such as oil-swollen Kraton triblock polymers; (2) crosslinked silicones including silicone oil-diluted polymers formed by crosslinking reactions such as vinyl silanes, and possibly other modified siloxane polymers such as silanes, or nitrogen, halogen, or sulfur derivatives; (3) oil-swollen crosslinked polyurethanes or ureas, typically made from isocyanates and alcohols or amines; (4) oil swollen polyesters, typically made from acid anhydrides and alcohols. Other gels are also possible.

In one aspect, a DE-28 type gel (manufactured by 3M Company, St. Paul, Minn.) or an EG5 grease (manufactured by 3M Company, St. Paul, Minn.) can be utilized.

Figure 5:
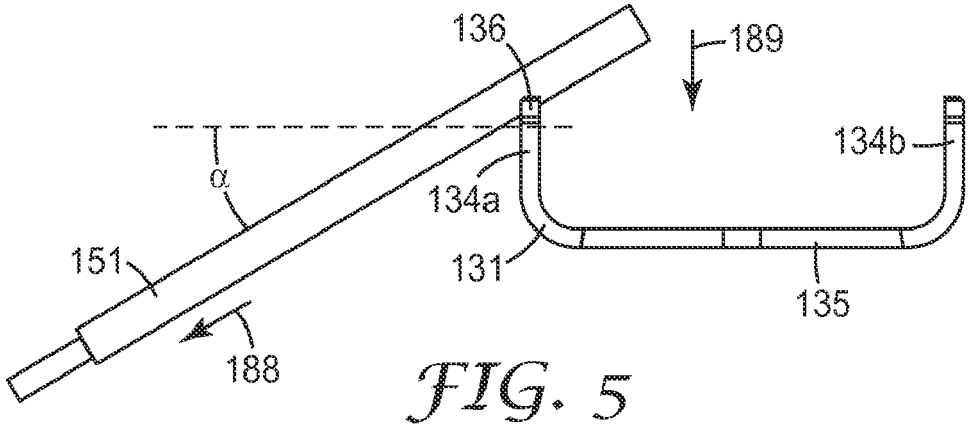
FIG. 5 is a schematic view of a wire being positioned for insertion into an IDC element of an in-line splice connector according to an aspect of the invention.

As mentioned above, the exemplary in-line splice connector includes a structure and retention feature that anchors the wires in the splice connector prior to full actuation and reduces the risk of wire disengagement. As shown in FIG. 5, during the wire insertion process, a wire, such as wire 151, is received in the connector at the IDC slot entrance 136 at a non-90° angle $\alpha$. In this example, angle $\alpha$ is about 30° with respect to a plane parallel to the plane of IDC base 135. A preferred insertion angle may be from about 20° to about 45°, depending on the application.

Figure 6:
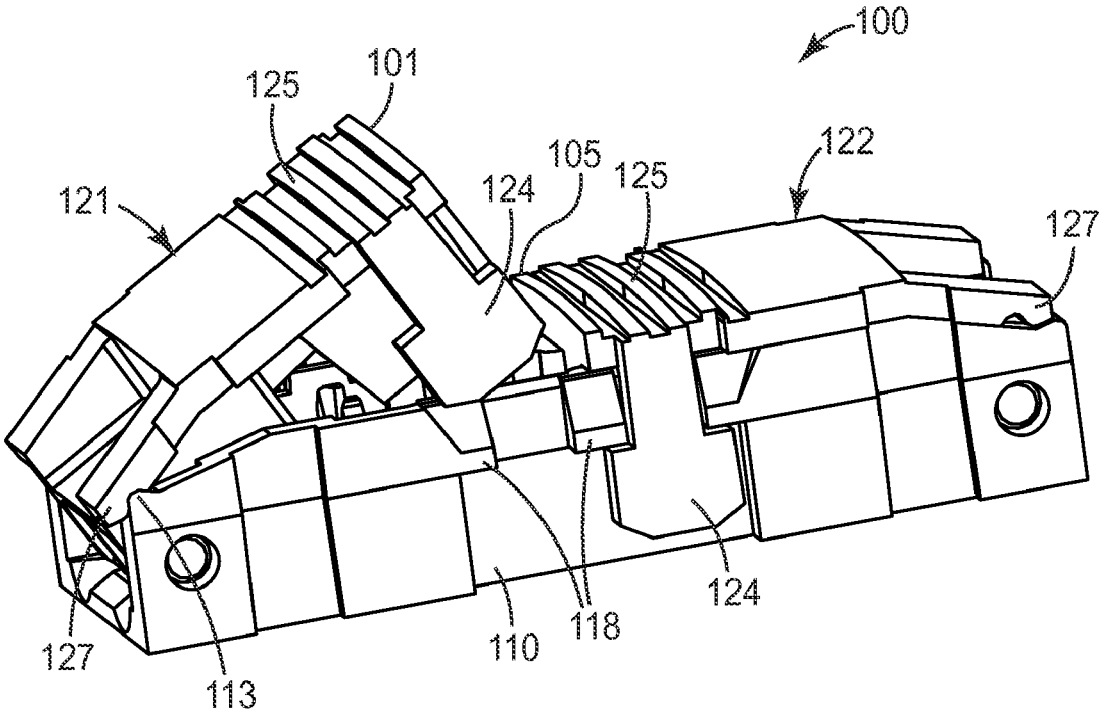
FIG. 6 is an isometric view of an in-line splice connector with caps in different positions according to an aspect of the invention.

In order to accommodate this preferred insertion angle, the connector body 110 and the connector cap(s) 121, 122 can be configured to automatically set the preferred wire insertion angle. FIG. 6 shows cap 121 at an open position 101 in connector body 110 corresponding to the preferred insertion angle $\alpha$. Cap 122 is shown in a closed position 105.

In the open position 101, the cap 121 is detented at the preferred insertion angle $\alpha$. The cap is held in this position by the detent structure described herein until acted on by a downward pressing force onto cap body portion 125.

In particular, in a preferred aspect, the cap 121 (and 122) includes a first (or upper) detent 127 formed on an outer edge of the cap body at the pivoting end of the cap (see e.g., FIGS. 7A and 7B). The opposite side of the cap can also include such a detent and is not shown in FIG. 6 for convenience purposes. In addition, cap 121 can include a second (or lower) detent 128 (see e.g., FIGS. 7A and 7B) formed on a lower rear edge of the cap at the pivoting end of the cap. The connector body 110 includes a detent 113 at a corresponding outer end location that engages the cap detent 127 and a detent pocket 111 to engage second detent 128. Moreover, in the open position 101, the retention piece 124*b* of the latch can rest on top of the catch 118. This structure provides additional and sufficient resistance against the cap being placed in a closed position 105. These detents can position the cap 121 at the preferred insertion angle, thus controlling the alignment of the wires during the initial splicing process.

In addition, as shown in FIG. 7A, cap 121 (and 122) includes wire guiding holes 123*a* and 123*b*. Each guiding hole is configured to receive and guide a standard wire, such as wire 151 or 152, towards the IDC element disposed in the connector body. In conjunction with the wire guiding holes 123*a* and 123*b*, the connector body 110 includes recessed portions 119 (see FIG. 7A) that are formed at the entrance edge of the connector body. These recessed portions 119 further accommodate passage of the wires as they are inserted in the cap 121 at the appropriate insertion angle. In a preferred aspect, the entrance portion of wire guiding holes 123*a* and 123*b* is at least partially chamfered to provide a wider acceptance angle for insertion of the wires.

Figure 7D:
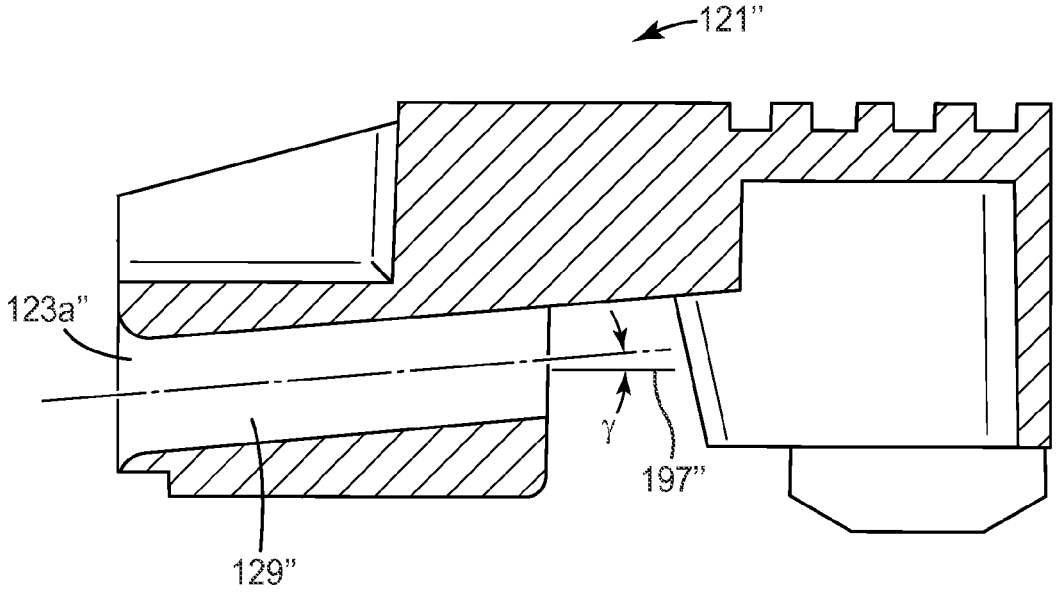
FIG. 7D is a cross-section view of another exemplary cap of the in-line splice connector according to an alternative aspect of the invention.

As shown in the exemplary aspect of FIG. 7D, a cross-section view of an alternative cap 121", the cap 121" can include a wire guiding hole 123*a*" that guides an inserted wire into a guide channel 129". In this aspect, the guide channel 129" can be slightly angled, e.g. inclined (with respect to a plane 197" parallel to the base of the connector body), at an angle $\gamma$ of about 2° to about 8°, preferably about 5°, for assisting with insertion of a wire into the IDC element (not shown) at the appropriate insertion angle. Alternatively, the guide channel 129" can be oriented parallel to the base of the connector when in the closed position.

With reference to FIG. 7B, a view of the underside of cap 121, the wires are pushed into the cap 121 until the wire ends reach wire stops 143. The wire stops are utilized by the installer to ensure that the inserted wires are of sufficient length to be fully connected to the IDC elements of the connector body. The stops 143 can be disposed at the end of wire channels 142, which provide side walls to help maintain the side-to-side alignment of the inserted wires.

The underside of cap 121 further includes wire drivers 141 disposed between the exit ends of the wire guiding holes and the wire stops. These wire drivers 141 are configured to be co-located with the U-shaped slots of the IDC elements (when the cap is fully mounted and actuated). In addition, the wire drivers are configured to push the inserted wires into the U-shaped slots of the IDC elements and provide a resistance surface against the wires as the cap is closed. The wire drivers 141 have a width sufficiently small enough to fit into the U-shaped slot of the IDC element when the cap is closed.

If necessary, the cap 121 and/or 122 can be re-opened after splicing by disengaging the latch 124 from the catch 118, using a small wedge tool or the like.

In this exemplary aspect, the cap body can include a textured surface portion for better gripping during the splicing operation, for example, see surface portion 125 shown in FIG. 7C.

Further, the front face of the caps 121 and 122 can include a wedged-shaped entrance (not shown) between the wire guiding holes 123*a* and 123*b* to help split and further guide individual wires from a wire pair.

Figure 8:
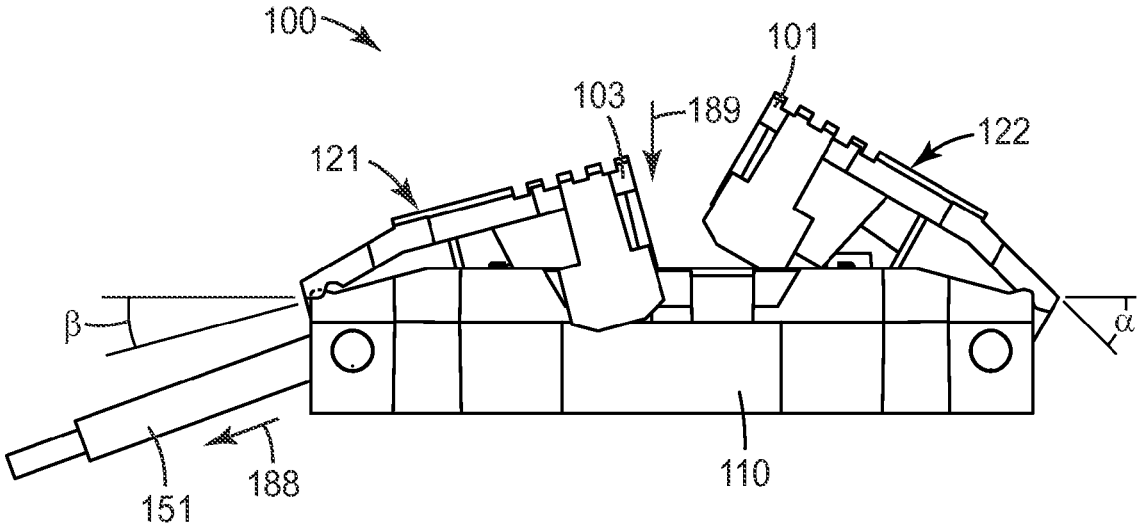
FIG. 8 is a side view of an in-line splice connector with caps in different positions according to an aspect of the invention.

FIG. 8 shows a connector 100 having cap 122 placed in an open position 101 and cap 121 being placed in an intermediate position 103. As stated above, the preferred initial insertion angle α can be about 30° from the plane of the connector body/IDC element base. The cap 122 can rest at this open position based on the detent structure of the cap and connector body described above.

In addition, through the application of a modest downward force (the amount of force will depend on overcoming the described detent structure and the wire gauge), the cap can be pivoted to an intermediate position 103 as the wire is partially driven (here wire 151) into the V-shaped and coined entrance slot of the IDC element secured in connector body 110. This retention feature can be utilized to maintain a proper splice even when the splicing wires are under slight axial tension or no slack is available. In one aspect, this intermediate (or "pre-crimp") angle β can be about 15° from the plane of the connector body/IDC element. In another aspect, this pre-crimp angle β can be from about 10° to about 20° from the plane of the connector body/IDC element.

In this pre-crimp position, the detents described above have been over-ridden or passed. This pre-crimp retention feature sets the wire in the IDC element at an angle such that for any axial pull made on wire 151 during the splicing process (e.g., along the direction of arrow 188, see also FIG. 5), the wire 151 will be further urged downward (e.g., along the direction of arrow 189, see also FIG. 5) and secured more tightly into the IDC element, thus reducing the risk of wire disengagement. From the pre-crimp position 103, the cap can be fully closed with the application of an additional downward force on the cap body portion 125.

An exemplary splicing sequence is shown with respect to exemplary in-line splice connector 200 shown in FIGS. 9A-9E. In-line splice connector 200 includes a connector body 210 that houses two IDC elements. First and second caps 221, 222 are pivotally mounted on connector body 210 in a manner similar to that described above. These caps are similarly used to actuate the splicing of wires 251, 252, 253, and 254 in an in-line manner. As shown in FIGS. 9A-9E, in-line splice connector 200 splices wire 251 to wire 253 and it splices wire 252 to wire 254.

Figure 9A:
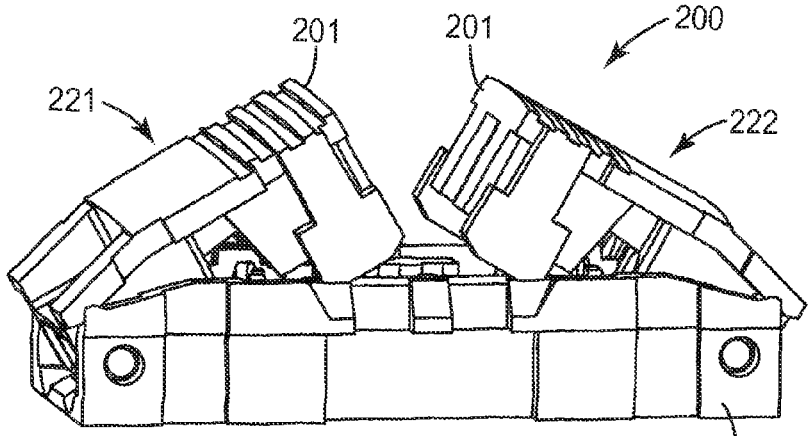
FIGS. 9A-9E show a splicing sequence using an in-line splice connector according to another aspect of the invention.
Figure 9B:
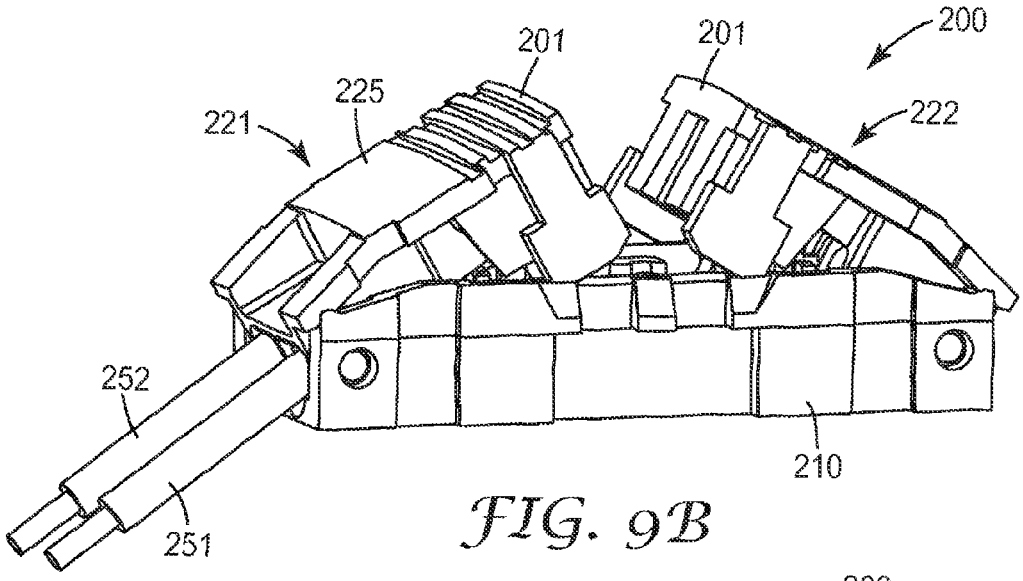

In FIG. 9A, both splicing caps 221, 222 are placed at an open position 201. The installer prepares the wires to be spliced (e.g., by collecting, unspooling, cutting, etc. wires 251-254) and places the wires in position. In FIG. 9B, a first wire pair 251, 252 is inserted in the first cap 221. As stated above, this open position 201 allows the cap to guide the wires 251, 252 over the entrance slots of the IDC elements (not shown) at a desired insertion angle. The wires 251, 252 are inserted until the wire ends reach respective wire stops, such as wire stops 143 described above.

Figure 9C:
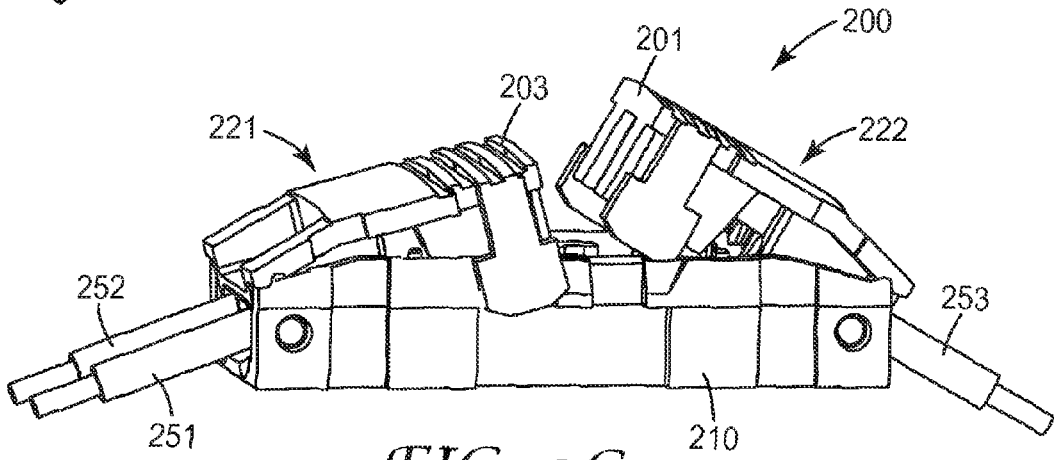
Figure 9D:
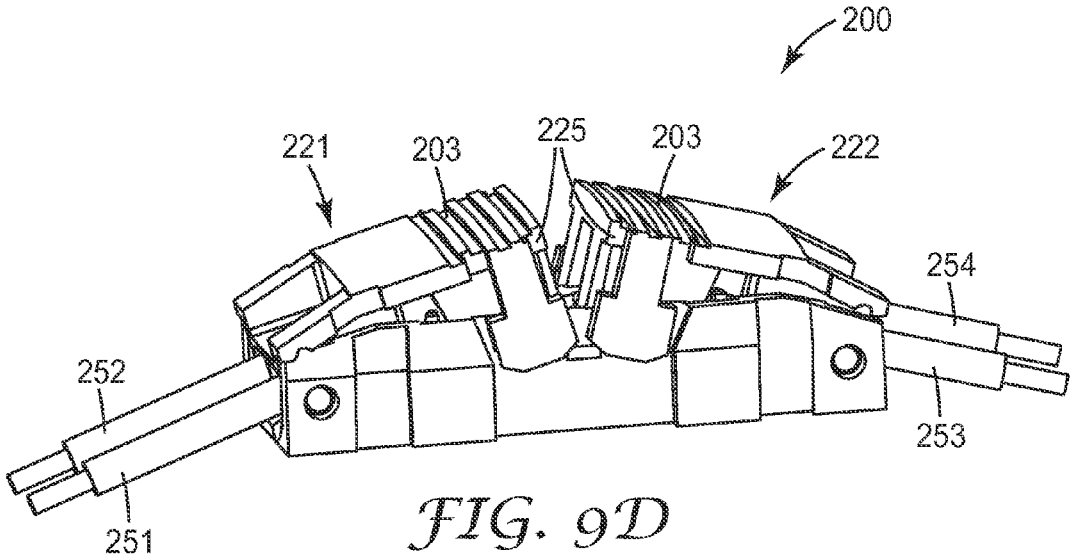

In FIG. 9C, the first cap 221 is pivoted (by application of a modest downward force on cap body portion 225) to a pre-crimp position 203, such as described above, to initially secure the wires 251, 252 in their respective IDC elements. FIG. 9C also shows wires 253, 254 that are inserted in the second cap 222 at the open position 201. Because the first cap 221 is in the pre-crimp position, the wires 251, 252 are secured in their respective IDC element during the insertion of wires 253, 254, thereby reducing the likelihood of wire disengagement prior to completion of the splice. The wires 253, 254 are inserted until the wire ends reach respective wire stops. In FIG. 9D, the second cap 222 is also pivoted (by application of a modest downward force on cap body portion 225) to a pre-crimp position 203 to secure the wires 253, 254 in their respective IDC elements. FIG. 9D shows both cap 221 and cap 222 at the pre-crimp position. In an alternative aspect, cap 221 or cap 222 can be fully actuated (i.e., placed directly in the closed positioned) prior to insertion of the wires in the other cap.

Figure 9E:
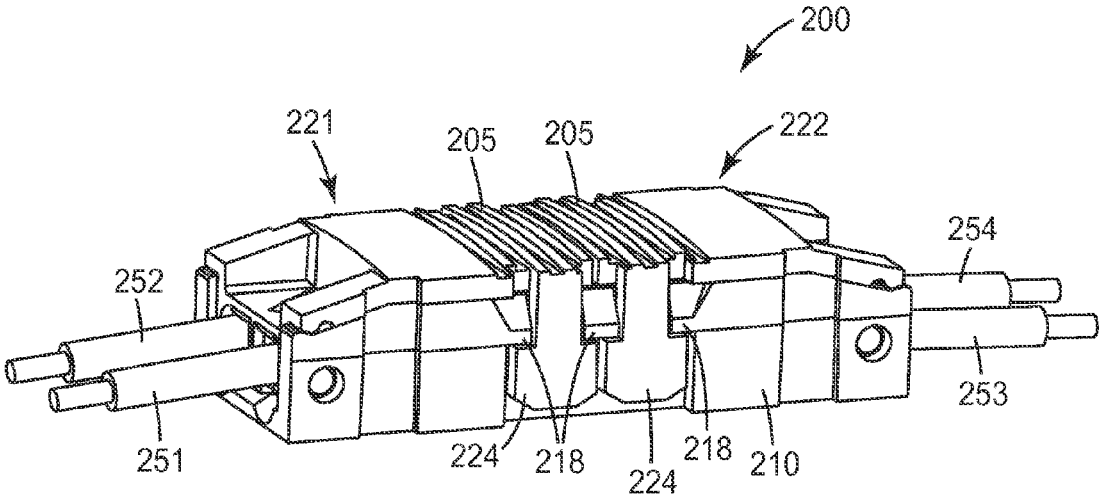

To fully actuate the splice, another modest force can be placed onto both cap body portions 225 either by hand force or a force applied by a conventional tool (e.g., an E-9 series BM, Model E-9 series J, or an E-9Y crimp tool, all available from 3M Company, St. Paul, Minn.) until the latches are fully engaged (as verified by visual inspection and/or a "snap" or "click" sound is heard), indicating a completed splice. This required force can be greater or lower, depending on the wire gauge of the spliced wires. FIG. 9E shows caps 221, 222 both in the fully closed position 205, where cap latches 224 are fully engaged by the connector body catches 218. For smaller gauge wires, a simple thumb press can be sufficient to fully close both caps to complete the splice. For example, for a 24 gauge wire, a modest force of about 12 lbs. to about 15 lbs. can be utilized to completely close the cap(s). With the caps fully engaged, an inadvertent/modest pull at an upward angle on any of the wires does not cause wire or cap disengagement.

Figure 10A:
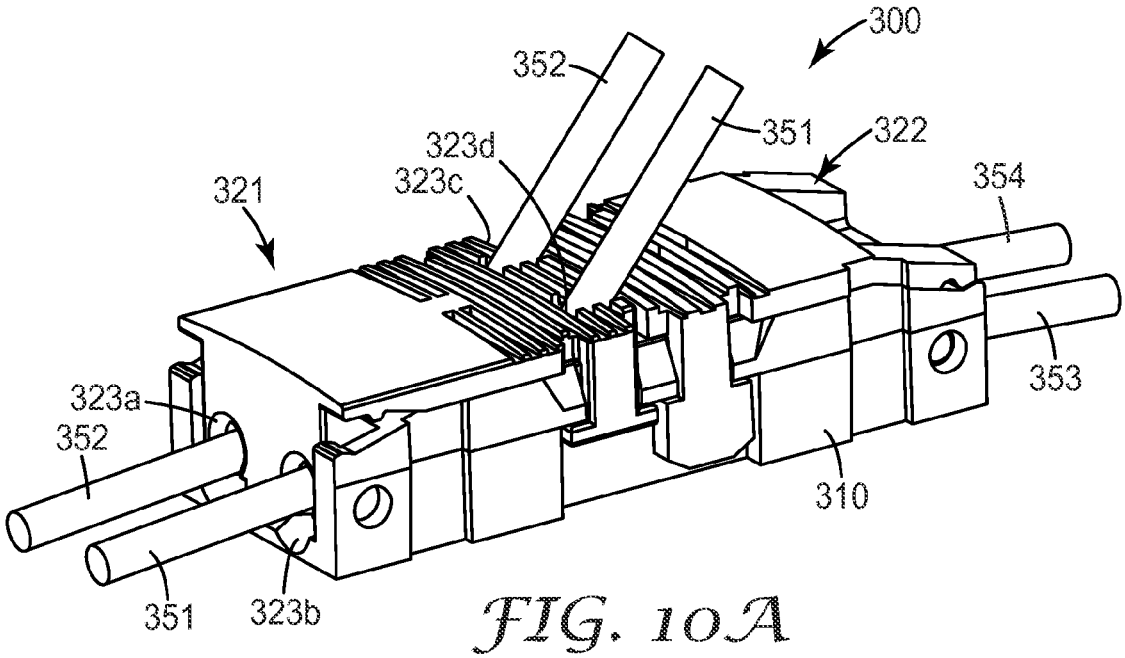
FIG. 10A is an isometric view of an in-line splice connector with a half-tap feature according to another aspect of the invention.

In an alternative aspect, FIG. 10A shows an alternative in-line splice connector 300 with a bridging or half-tap feature. Here, in-line splice connector 300 includes a connector body 310 that houses two IDC elements (not shown), similar to the IDC elements described above. First and second caps 321, 322 can be pivotally mounted on connector body 310. In this configuration, an incoming pair of wires (here wire pair 351, 352) is passed completely through cap 321. The incoming pair of wires is coupled to a set of tap wires 353, 354 that are disposed in cap 322. In this alternative aspect, cap 321 includes entrance guide slots 323*a* and 323*b* and exit guide slots 323*c* and 323*d* (cap 321 would not include wire stops for this application). Cap 321 can then be attached to the connector body after the wires 351, 352 are placed in entrance guide slots 323*a* and 323*b* and exit guide slots 323*c* and 323*d*.

Figure 10B:
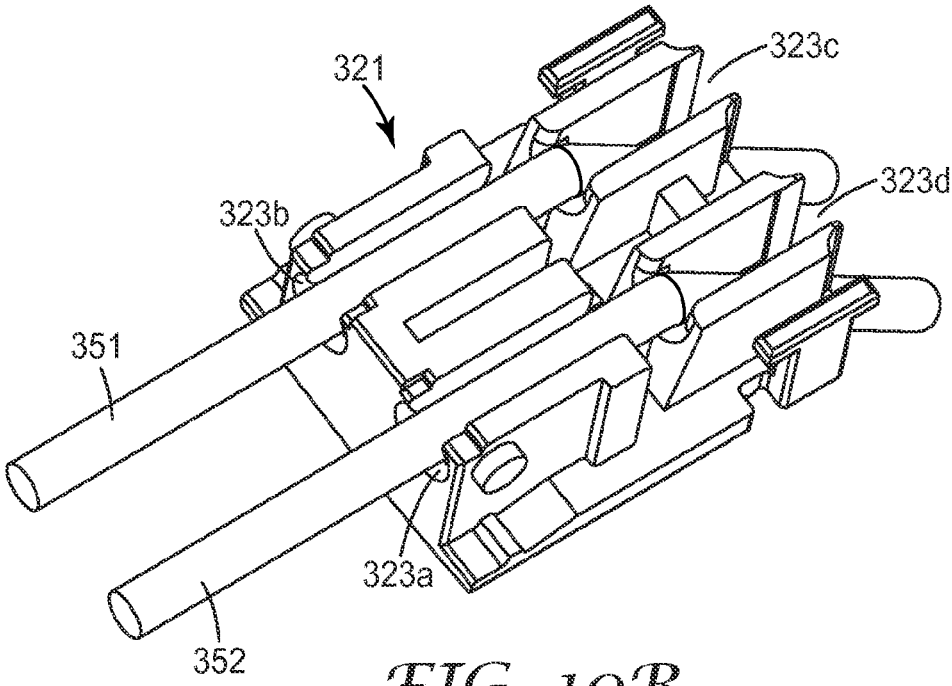
FIG. 10B is an isometric view of the underside of the exemplary cap 321 of the in-line splice connector of FIG. 10A.

FIG. 10B shows a view of the underside of cap 321. In this aspect, wires 351 and 352 are inserted onto the cap through open retention slots formed on the underside of cap 321 between entrance guide slots 323*a* and 323*b* and exit guide slots 323*c* and 323*d* that allow insertion of the wires without having to cut the wires (thereby avoiding a disruption of service). The cap can then be coupled to the connector body 310 using a trunnion/receptacle mechanism such as described above with respect to connector 100. The connector body 310 can be similar to the connector bodies described above and include a pair of IDC elements (not shown). In this aspect, cap 322 can be configured the same as caps 122 and 222 described above. In operation, tap wires are 353 and 354 are inserted in cap 322 in a manner similar to that described above. Once cap 322 is fully actuated, the wires 353, 354 can transmit the signals tapped from wires 351, 352.

Figure 11A:
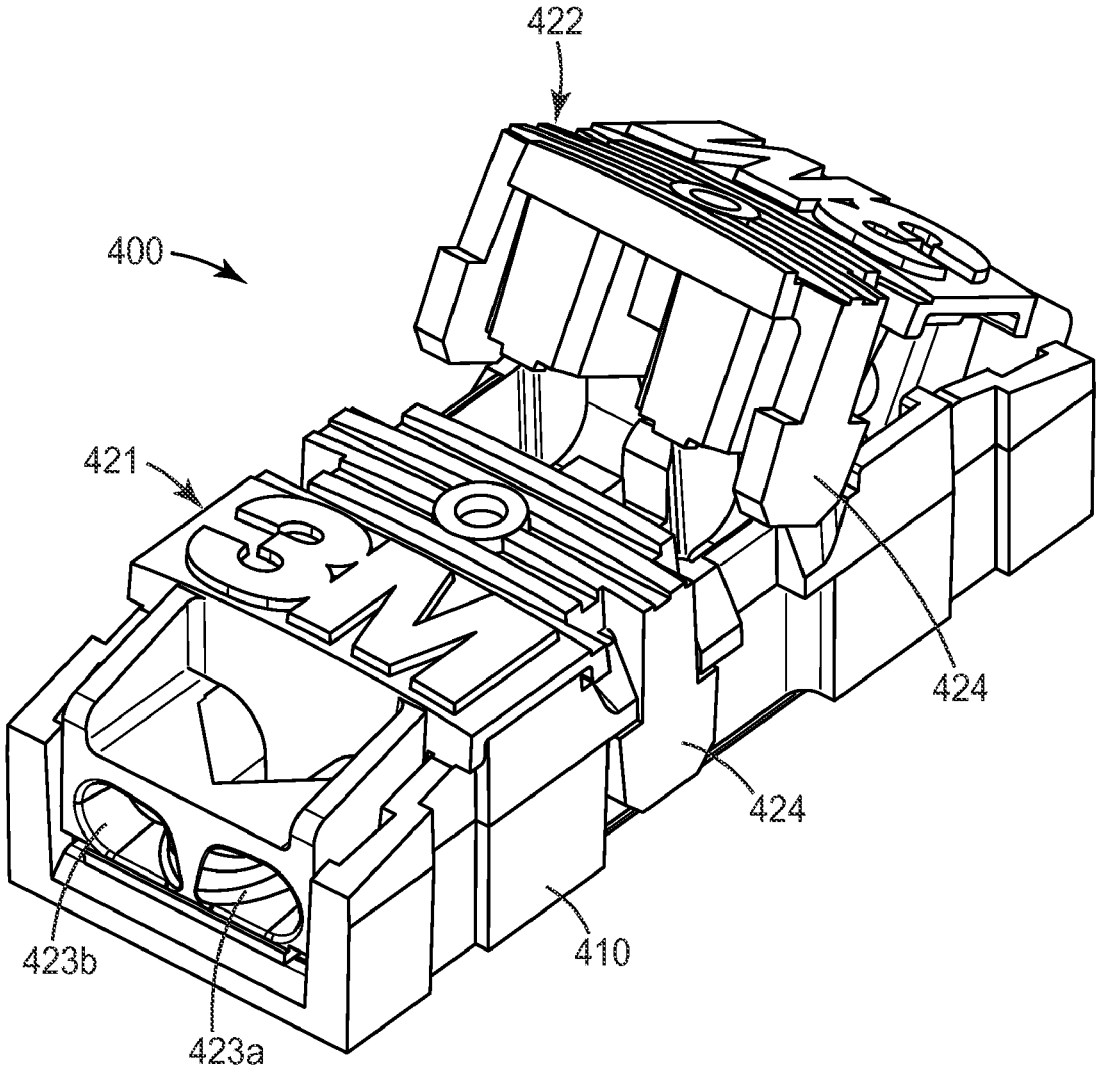
FIGS. 11A-11C show different views of an in-line splice connector according to another aspect of the invention.
Figure 11B:
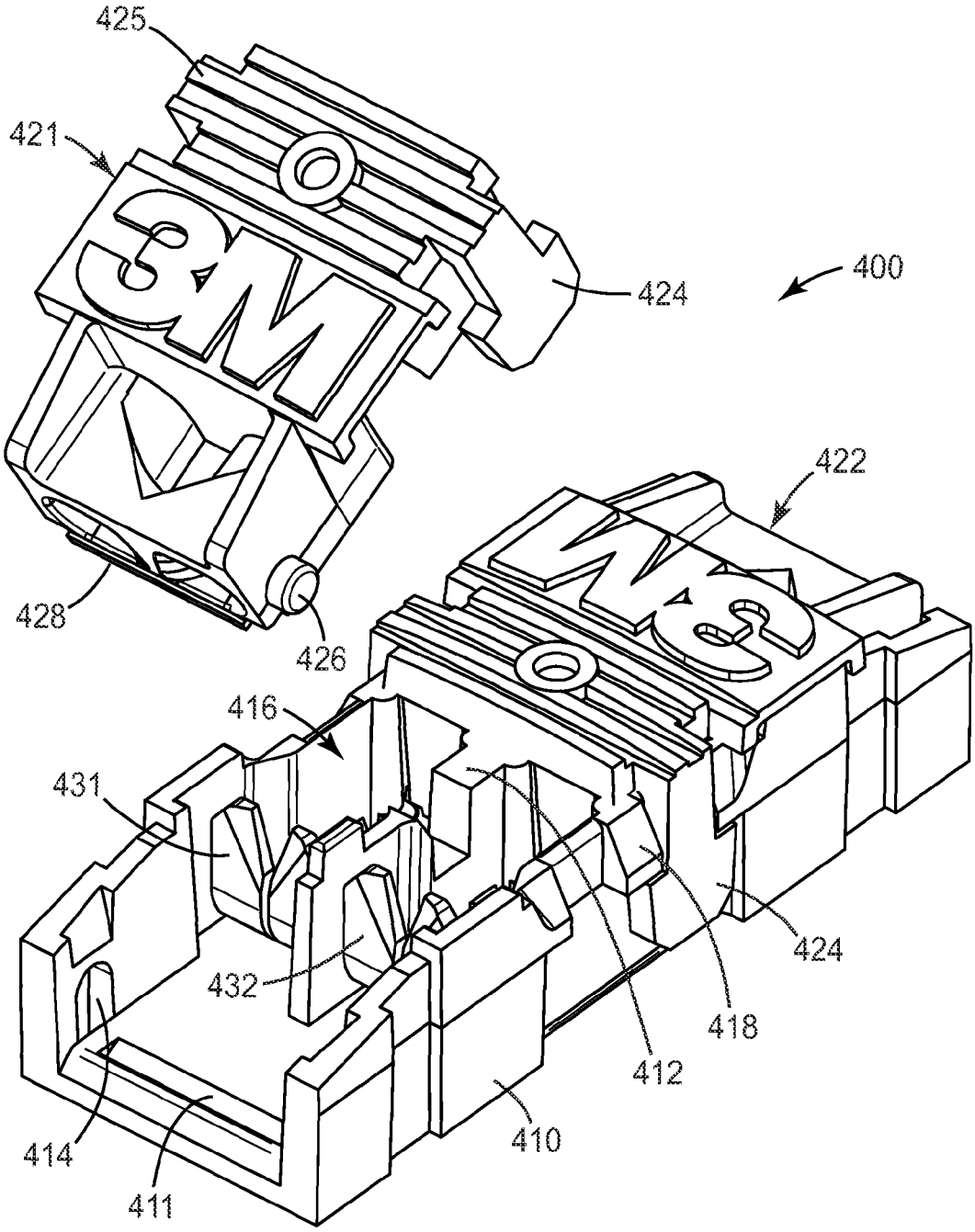
Figure 11C:
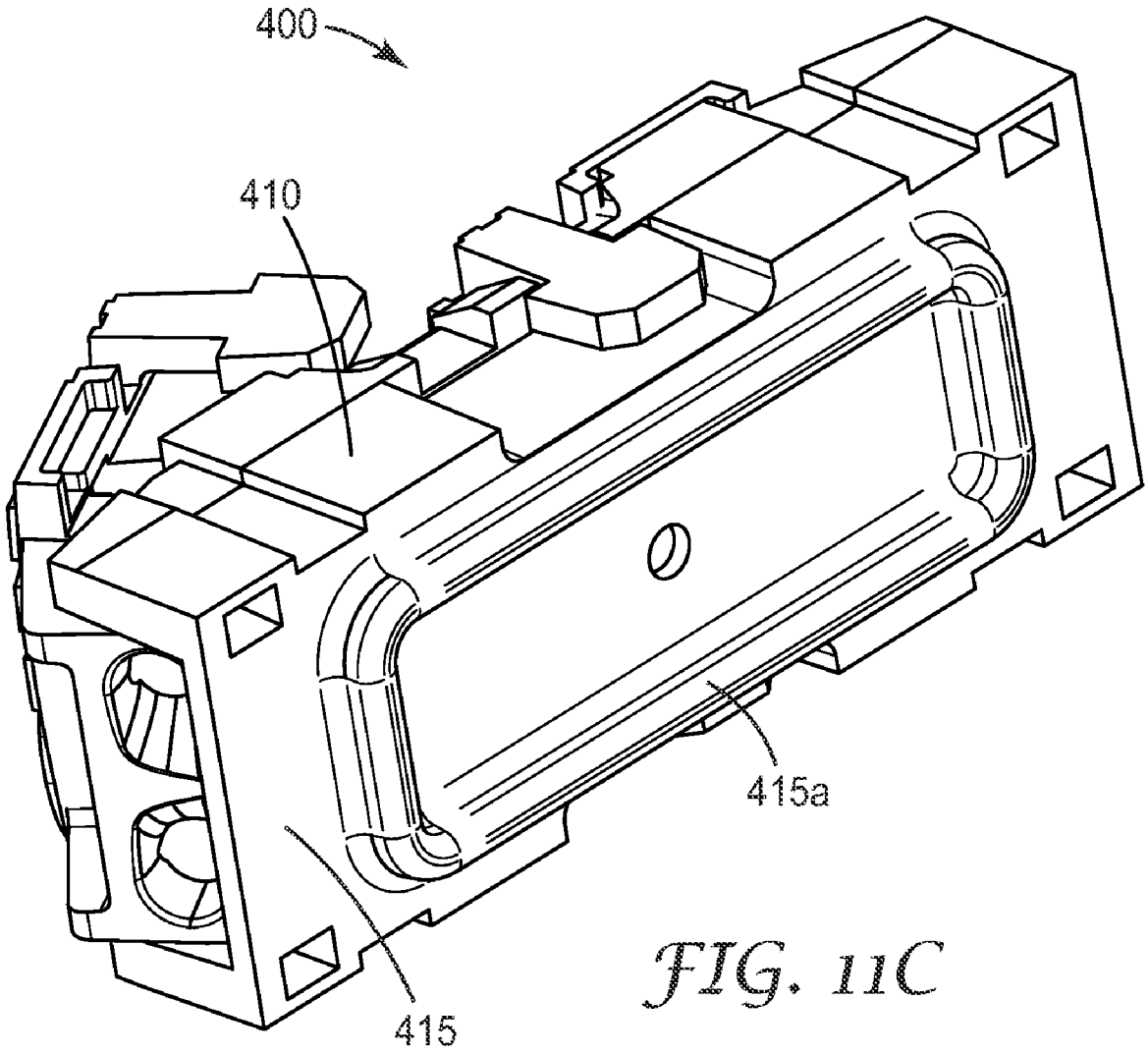

In a further alternative aspect, FIGS. 11A-11C show an alternative in-line splice connector 400. In-line splice connector 400 includes a connector body 410 that houses one or more insulation displacement connector elements (IDC elements 431, 432, see FIG. 11B). First and second caps 421, 422 actuate the splicing of one or more wires (not shown) in an in-line manner. Similar to the in-line splice connectors 100, 200 described above, connector 400 includes two pivoting caps 421, 422 that each pivot from a position at an end portion of the connector body 410.

The connector body 410 includes a generally elongated cavity region 416 formed in the central part of the body. IDC elements 431 and 432 are securely housed in the cavity region 416. The cavity regions of the connector body can be filled with a sealant (not shown), such as a conventional gel, to help prevent moisture from entering the terminal compartment and corroding the terminal.

In addition, the connector body 410 also includes receptacles 414 at (or near) each end and on opposite inside facing walls of the connector body. These receptacles 414 are configured to receive protrusions or trunnions 426 formed on caps 421, 422. In this aspect, the receptacles 414 are formed as slots.

Similar to the in-line splice connectors 100, 200 described above, the trunnion/receptacles for connector 400 interact to provide a pivot axis for each cap to move from an open position (see cap 422 in FIG. 11A, where wires are inserted into the connector) to a closed position (see cap 421 in FIG. 11A, where the wires are spliced).

According to an exemplary embodiment of the present invention, connector body 410 and caps 421 and 422 are formed or molded from a polymer material. In one exemplary aspect, connector body 410 and caps 421 and 422 are formed from a polycarbonate material. The caps and/or the connector body can also be formed from a transparent material, which provides for visual inspection of the wires prior to and after splicing.

Connector 400 can be utilized to splice standard size electrical conductors, such as copper or steel wires, having a diameter of from about 0.4 mm (26 gauge) to about 0.8 mm (20 gauge). Each wire has a jacket formed of an insulation material, such as polyvinylchloride (PVC). Also, the wires are not required to each be of the same size.

Each IDC element 431, 432 can have an elongated U-shape that includes a main base portion that connects first and second end portions that each have a funnel or V-shaped slot wire reception formed therein that are configured to engage the wires to be spliced, as is described above. The V-shaped wire reception slots have a structure that can displace the insulation layers of the wires inserted in them to allow contact with the conductor(s) in the wires. In an exemplary aspect, the upper or open ends of wire reception slots are coined as is described above. This coining provides a sharper edge for the inner displacement channel and allows the wire insulation to be cut and engaged by the element with less downward force applied to the wire. The IDC elements 431, 432 can both comprise a conductive metal material, such as those described above.

FIG. 11B shows the elements 431 and 432 secured in the cavity region 416 of the connector body 410, where the elements are separated by a central wall 412. The central wall and the inner surface of the connector body walls can include conforming guiding structures to help secure the IDC elements, in a similar manner as is described above.

Connector body 410 further includes protrusions or catches 418 formed on outer surfaces of connector body 410 that are configured to engage latches 424 that extend downward from the top portion of caps 421, 422. The catch and latch structure can be similar to that described above for caps 121, 121', 122.

As mentioned above, the exemplary in-line splice connector includes a structure and retention feature that anchors the wires in the splice connector prior to full actuation and reduces the risk of wire disengagement. A preferred insertion angle may be from about 20° to about 45°, depending on the application.

In order to accommodate this preferred insertion angle, the connector body 410 and the connector cap(s) 421, 422 can be configured to automatically set the preferred wire insertion angle. FIG. 11A shows cap 422 at an open position in connector body 410 and cap 421 is shown in a closed position. In the open position, the cap 422 is temporarily held at a preferred insertion angle. In this aspect, either cap can be held in this position by a cap detent 428 (see FIG. 11B—both caps 421 and 422 can have a similar cap detent) cooperating with a detent pocket 411 formed in the connector body. In this aspect, the cap detent 428 and detent pocket 411 can span a substantial portion of the width of the connector. An additional cooperating detent structure formed on the outer surfaces of the caps and connector body above the protrusions or trunnions 426 is not required. The caps can be moved from this temporary position by the application of a downward pressing force.

In addition, as shown in FIG. 11A, cap 421 (and 422) includes wire guiding holes 423*a* and 423*b* configured to receive and guide a standard wire towards the IDC element disposed in the connector body The underside of caps 421, 422 (not shown) can include wire stops, similar to those described above, to ensure that the inserted wires are of sufficient length to be fully connected to the IDC elements of the connector body. The stops can be disposed at the end of wire channels, which provide side walls to help maintain the side-to-side alignment of the inserted wires. Caps 421, 422 can further include wire drivers (similar to those described above) disposed between the exit ends of the wire guiding holes and the wire stops, and which are configured to be co-located with the U-shaped slots of the IDC elements (when the cap is fully mounted and actuated). The wire drivers are configured to push the inserted wires into the U-shaped slots of the IDC elements and provide a resistance surface against the wires as the cap is closed.

In this exemplary aspect, the cap body 421 can include a textured surface portion for better gripping during the splicing operation, for example, see surface portion 425 shown in FIG. 11B.

As shown in FIG. 11C, connector body 410 includes a bottom surface 415 that can incorporate an integral spacer structure 415*a* to further separate the connector body from an adjacent connector disposed underneath/above the surface 415. This separation can reduce interference effects. The spacer 415*a* can be formed as a rectangular shape, such as shown in FIG. 11C, or it may have an alternative shape.

Overall, the embodiments of the in-line splice connector each include a structure and retention feature that anchors wires to be spliced in the splice connector prior to full actuation. This structure and retention feature also reduces the risk of wire disengagement during the splicing sequence. In particular, with the caps pivoted at (or near) each end of the connector, the inadvertent upward pulling of a spliced wire will not result in wire/cap disengagement.

Various modifications, equivalent processes, as well as numerous structures to which the present invention may be applicable will be readily apparent to those of skill in the art to which the present invention is directed upon review of the present specification.

We claim:

1. An in-line splice connector, comprising:

a connector body having a first end and a second end opposite the first end and having a generally elongated cavity region formed between the first and second ends to house at least a first insulation displacement connector (IDC) element; and a first cap and a second cap, each cap including a wire guide to receive and guide a wire to the IDC element, wherein the first cap is pivotally mounted at the first end of the connector body to receive a first wire and wherein the second cap is pivotally mounted at the second end of the connector body to receive a second wire, and wherein a closing of the first and second caps actuates a splice of the first and second wires, wherein the first and second caps respectively pivot at the first and second ends of the connector body so that each of the caps closes towards the center of the connector, thereby pushing received wires into the first IDC element during an actuation process.

2. The in-line splice connector of claim 1, wherein the connector body further houses a second IDC element, and wherein the first and second caps each include at least two wire guides.

3. The in-line splice connector of claim 2, wherein the IDC elements each comprise an elongated U-shape that includes a main base portion that connects first and second end portions, wherein each of the first and second end portions include a V-shaped and coined entrance slot to receive a wire, the V-shaped and coined entrance slot being configured to force the wire towards the main base portion upon an axial pull of the wire in a direction away from the in-line splice connector.

4. The in-line splice connector of claim 2, wherein the first cap includes at least one detent that engages the connector body to hold the first cap at a first angle with respect to the plane of the connector body, wherein the first angle is from about 20° to about 45° .

5. The in-line splice connector of claim 2, wherein the connector body includes receptacles disposed proximate to the first and second ends and on opposite inside facing walls of the connector body, and wherein the receptacles are configured to receive trunnions formed on an outer surface of the first and second caps.

6. The in-line splice connector of claim 2, wherein the generally elongated cavity region includes a first cavity portion and a second cavity portion separated by a central wall, wherein the central wall and inner surfaces of the connector body walls include conforming guiding structures to secure the first and second IDC elements therein.

7. The in-line splice connector of claim 6, wherein the central wall includes rib structures disposed thereon proximate to first and second ends of the IDC elements.

8. The in-line splice connector of claim 2, wherein the first cap includes first and second latches formed on opposition side walls thereof and configured to engage tapered protrusions formed on opposite outer surfaces of the connector body.

9. The in-line splice connector of claim 4, wherein the first cap is pivotable to a second angle with respect to the plane of the connector body, wherein the second angle is from about 10° to about 20° .

10. The in-line splice connector of claim 2, wherein the first cap includes:

a wire stop formed on an underside of the first cap that impedes forward axial motion of the first wire inserted in one of the wire guides; and a wire driver disposed between an exit end of the wire guide and the wire stop, and co-located with U-shaped slots of the first IDC element when the first cap is in a closed position on the connector body to provide a resistance surface against the first wire as the first cap is closed.

11. The in-line splice connector of claim 1, wherein the first cap comprises a half-tap cap, wherein the first cap includes an exit slot formed in an upper surface thereof to permit the first wire to exit the connector, wherein the second wire is electrically coupled to the first wire when the first cap is placed in a closed position.

12. The in-line splice connector of claim 1, further comprising an integral spacer structure formed on a bottom surface of the connector body.

13. An in-line splice connector, comprising:

a connector body having a first end and a second end opposite the first end and having a generally elongated cavity region formed between the first and second ends to house at least a first insulation displacement connector (IDC) element; and a first cap and a second cap, each cap including a wire guide to receive and guide a wire to the IDC element, wherein the first and second caps respectively pivot at the first and second ends of the connector body so that each of the caps closes towards the center of the connector, wherein the IDC elements each comprise an elongated U-shape that includes a main base portion that connects first and second end portions, wherein each of the first and second end portions include a V-shaped and coined entrance slot to receive a wire, the V-shaped and coined entrance slot being configured to urge the wire towards the main base portion upon an axial pull of the wire away from the in-line splice connector.

14. An in-line splice connector, comprising:

a connector body having a first end and a second end opposite the first end and having a generally elongated cavity region formed between the first and second ends to house at least a first insulation displacement connector (IDC) element; and a first cap and a second cap, each cap including a wire guide to receive and guide a wire to the IDC element, wherein the IDC elements each comprise an elongated U-shape that includes a main base portion that connects first and second end portions, wherein the first cap is pivotally mounted to the connector body at a position between the first end of the connector body and the first end portion of the IDC element, and wherein the second cap is pivotally mounted to the connector body at a position between the second end of the connector body and the second end portion of the IDC element, wherein the first and second caps respectively pivot at the pivot positions so that each of the caps closes towards the center of the connector, thereby pushing received wires into the first IDC element during an actuation process.

* * * * *